United States Patent [19]

Aguero

[11] 4,443,898

[45] Apr. 24, 1984

[54] AUTOMATIC TOILET FLUSHING DEVICE

[76] Inventor: Lazaro Aguero, Dade County, Fla.

[21] Appl. No.: 375,865

[22] Filed: May 7, 1982

Related U.S. Application Data

[63] Continuation-in-part of Ser. No. 179,766, Aug. 20, 1980, Pat. No. 4,329,745.

[51] Int. Cl.[3] ..... E03D 5/04; H01H 13/52

[52] U.S. Cl. ..... 4/313; 4/250; 4/302; 4/305; 4/408; 200/160

[58] Field of Search ..... 4/249, DIG. 3, 408, 4/381, 394, 395, 391, 313, 325, 250, 300, 302, 305, 330, 405, 468, 411, 412, 413, 414; 200/160

[56] References Cited

U.S. PATENT DOCUMENTS

| | | | |
|---|---|---|---|
| 737,859 | 9/1903 | Nelson | 4/381 |
| 920,928 | 5/1909 | Davis | 4/408 |
| 997,448 | 7/1911 | Henn | 4/408 |
| 1,135,028 | 4/1915 | Kreter | 4/408 |
| 1,564,122 | 12/1925 | Campbell | 4/408 |
| 1,676,550 | 7/1928 | Hanamann | 4/408 |
| 2,628,363 | 2/1953 | Stein | 4/395 |
| 2,690,567 | 10/1954 | Quebbeman | 4/381 |

*Primary Examiner*—Henry K. Artis
*Attorney, Agent, or Firm*—Jesus Sanchelima

[57] ABSTRACT

YAn improved automatic flushing device for valve actuated toilets that is capable of being housed inside the toilet's water tank, out of the user's sight. The conventional water supply valve system is not altered and the flush valve assembly is actuated through floating means arranged in such a way that, depending on the water levels inside the tank, will urge the opening of the flush valve. When enough water has been drained out, the action of the floating means ceases and a tripping mechanism engages locking the floating means thereby preventing it from opening the flush valve again until the tripping mechanism is triggered in response to the users removing his or her weight from the toilet seat.

2 Claims, 4 Drawing Figures

AUTOMATIC TOILET FLUSHING DEVICE

BACKGROUND OF THE INVENTION

1. Other related inventions.

The present invention is a continuation-in-part of U.S. patent application Ser. No. 06/179,766 filed on Aug. 20, 1980 now U.S. Pat. No. 4,329,745.

2. Field of the Invention.

The present invention relates to automatic flushing devices for toilets, and more particularly, to such devices that are completely inside the toilet tank.

3. Description of the Prior Art.

Several devices have been designed in the past to provide an automatic flushing operation, however, none of them provide a separate function for the opening of the chain valve as the one herein claimed and described, while at the same time, being completely out of the sight of the user.

SUMMARY OF THE INVENTION

It is the main purpose of the present invention to provide an automatic flushing device for valve actuated toilets that is self-contained within the toilet's tank.

It is another object of the present invention to provide an automatic toilet flushing device having tripping means actuated by sensing the weight of the user and insuring a steady drain of the water from the toilet's tank.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
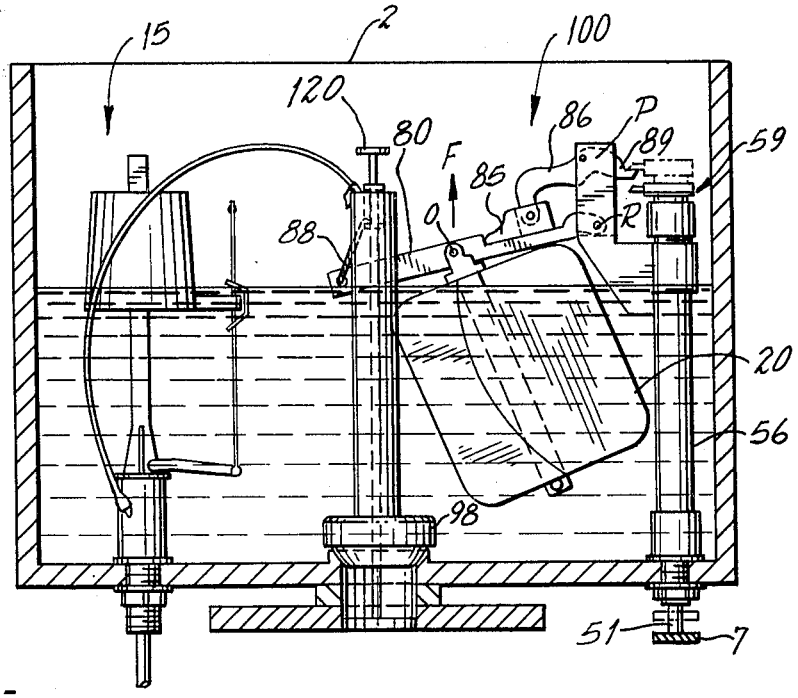
FIG. 1 represents a front view of the tank with its front wall removed, showing the different elements of the present invention before the user sits down, and in phantom it represents the position of the actuator after the user sits down.

Referring to FIG. 1, where the present invention is referred to in general by numeral 100, it can be observed that this illustration represents the interior of a toilet tank with conventional float actuated valve assembly 15 on the left. The mechanism of assembly 15 will not be discussed here since it is well known and it is not a part of the invention herein claimed. The important feature of assembly 15 being that after the water inside tank 2 achieves a predetermined level its valve is either open or closed.

Figure 4:
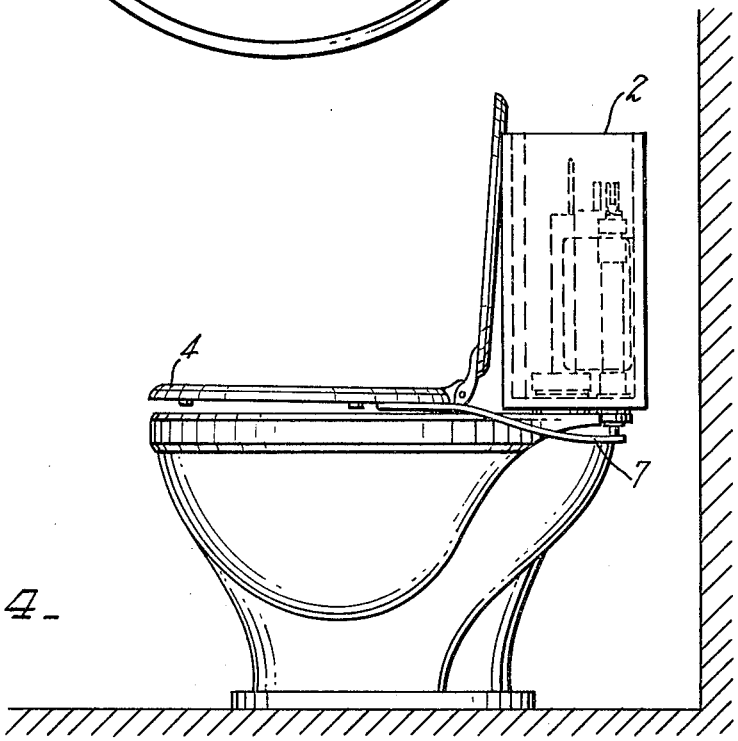
FIG. 4 is a side view of the toilet illustrating the invention being housed inside the tank.

As in the parent application, the present improved automatic toilet flushing device 100 is actuated through a rigid arm 7 that is horizontally mounted on the toilet's seat bottom and positioned in cooperation with elongated member 51 which is spring biased within tube 56 urging member 51 downwardly towards arm 7 in such a manner as to lift toilet seat 4, slightly, when no one is sitting on it as shown in FIG. 4. The spring bias action is overcome when the user sits down, causing arm 7 to push member 51 upwardly which in turn makes cam assembly 59 move upwardly since it is rigidly mounted on the upper end of member 51. Cam assembly 59, like in the preferred embodiment disclosed in the parent application, comprises a cover 61 housing a spring biased actuating pin 62 having a cam termination that comes in contact with a cooperating surface on actuating link 86. Link 86 pivots on point P which is a fixed point with respect to tube 56 that guides cam assembly 59. The other end of link 86 is hingedly connected to shoe member 85 that fits abuttingly with shoulder 84 of rigid lever 80 thereby providing a tripping mechanism that counteracts the upward force F applied at point 0 by floating member 20. In other words, force F as shown in FIG. 1, will be offset by the vertical component of the reaction force produced by the shoe member 85 and actuating link 86 assembly which is directed to the left along rigid lever 80.

Figure 2:
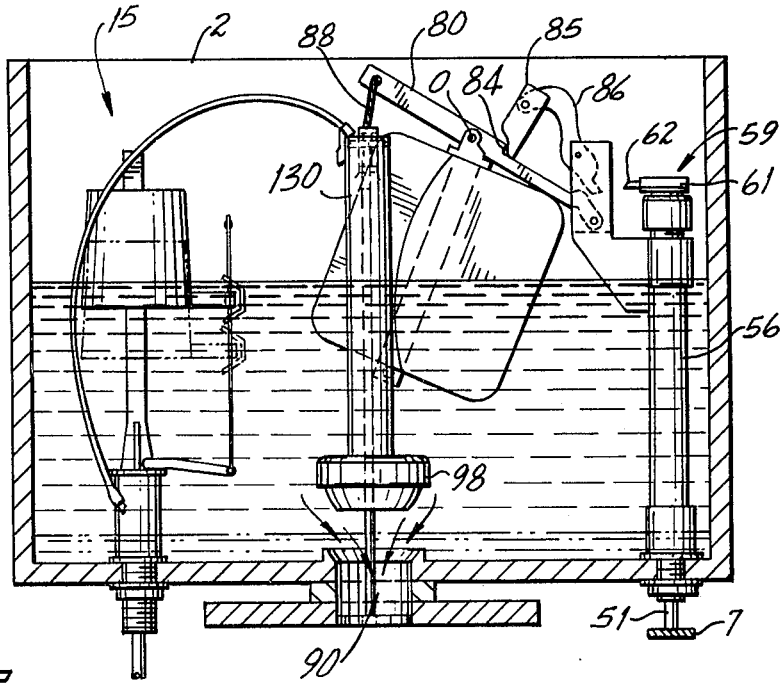
FIG. 2 illustrates the device after being tripped by the user's action of standing up.
Figure 3:
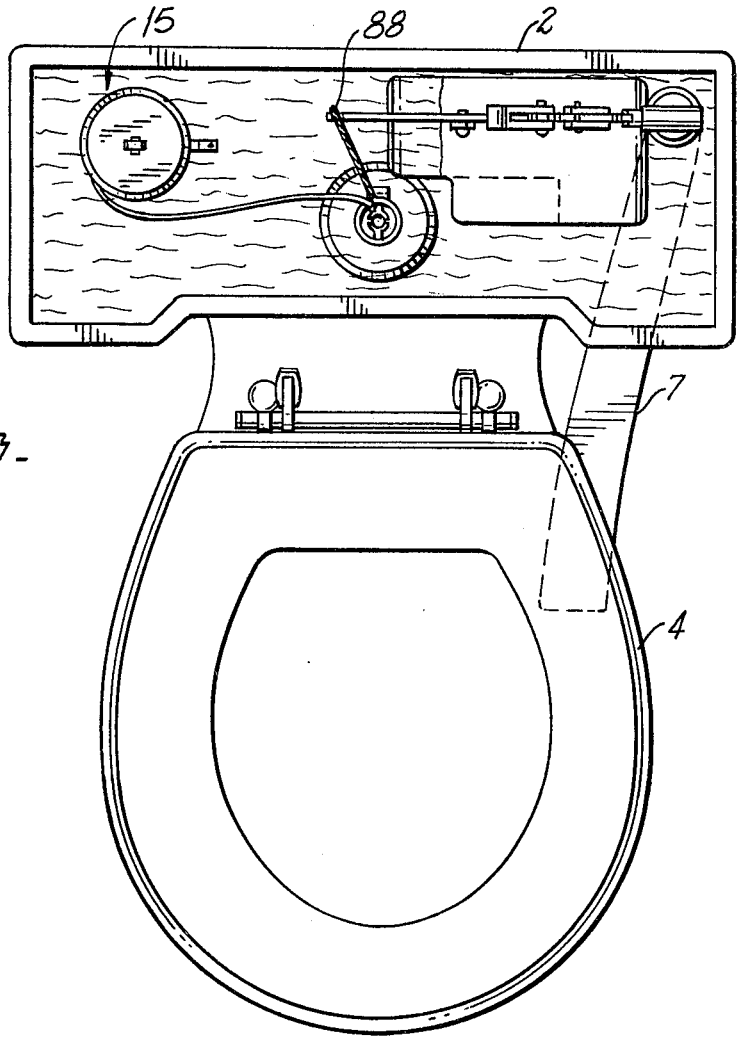
FIG. 3 is a top view of the toilet and tank without its cover.

When cam assembly travels upwardly, as shown in phantom in FIG. 1, spring biased actuating pin 62 passes cooperating cam termination 89 of actuating link 86, engaging it from its upper surface. This operation occurs when the user sits down, thereby setting it ready to trigger the tripping mechanism composed of shoe 85 and link 86 when the user gets up. The reaction force along lever 80 is lost and floating force F creates a clockwise torque pulling chain 88, as shown in FIG. 2, causing the water in tank 2 to drain out through drain valve 98 flushing the toilet.

In the conventional toilet, drain or flush valve 98 usually has an air trap that makes it float somewhat so that when it is pulled up by chain 88 it remains above drain opening 90 thereby allowing the water in the tank to drain out. It is not unusual to find toilets where flush valve 98 falls on opening 90 unless the user keeps his hand on the actuating lever. This problem is solved with floating member 20, separating the floating function required to make valve 98 to stay open from the valve function itself. The present invention will insure then that valve 98 will stay open until the water level has achieved a certain predetermined level in a similar manner as it is done with the conventional float actuated valve assembly 15. Once enough water has been drained out, floating member 20 drops down to the position shown in FIG. 1, allowing flush valve 98 to come down and close drain opening 90. When the water level in tank 2 starts to increase again, floating member 20 will displace a certain body of water with the consequent upward floating force being produced. However, the tripping mechanism composed of shoe member 85 and actuating link 86 will have locked rigid lever 80 in place, preventing it from rotating clockwise. When the user sits down on seat 4, cam assembly 59 engages cooperating cam termination 89 of actuating link 86, as shown in phantom in FIG. 1. When the user removes his weight from seat 4, the above referenced tripping mechanism is triggered allowing lever 80 to rotate clockwise by the upward floating force of floating member 20. In essence, the small rotational movement of seat 4 is converted to a vertical up and down movement that is amplified by the tripping mechanism and floating member 20 arrangement, thereby insuring continuous drain of water through drain aperture 90. Valve 98, in the preferred embodiment, is connected to tubular member 130 which in turn is connected to chain 88. Guiding member 120 keeps tubular member 130 in place.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense, except as set forth in the following appended claims.

What is claimed is:

1. An automatic flushing device for toilets having a flush valve operable for releasing water from a flush tank to a toilet bowl provided with a seat hinged upon the bowl for pivotal movement around a horizontal axis at the rearward end of the seat, said device comprising, in operative combination:

a. an elongated arm secured to said seat and extending rearwardly underneath said flush tank;

b. means for reciprocating pivotal movements of said seat, and transmitted through said arm, along a vertical axis;

c. means for spring biasing said means for reciprocating pivotal movements of said seat so as to urge said arm slightly downwardly thereby lifting said seat slightly from said bowl;

d. floating means for actuating said flush valve within predetermined water levels in said tank;

e. tripping means disposed so as to prevent said floating means from actuating said flush valve and responsive to the relative positions of said means for reciprocating for triggering its tripping function and wherein said tripping means includes an actuating link having a cam termination in cooperation with said means for reciprocating the pivotal movements of said seat and a shoe member hingedly connected to said actuating link and adapted to prevent the actuation of said flush valve by said floating means until said tripping means is actuated.

2. The device set forth in claim 1 wherein said floating means include a rigid lever that is pivoted on one end at a fixed point with respect to said tank and chain means attached to the other end and said chain being connected to said flush valve assembly and adapted to actuate it.

* * * * *